United States Patent [19]

Frye et al.

[11] Patent Number: 4,539,072

[45] Date of Patent: Sep. 3, 1985

[54] CURL NEUTRALIZER

[75] Inventors: Kenneth G. Frye, Egremont; Arthur T. Karis, Lenox, both of Mass.

[73] Assignee: Beloit Corporation, Beloit, Wis.

[21] Appl. No.: 575,655

[22] Filed: Jan. 31, 1984

[51] Int. Cl.[3] ..... D21F 7/00; B65H 23/34

[52] U.S. Cl. ..... 162/197; 162/271; 226/195; 226/39; 493/459

[58] Field of Search ..... 162/197, 270, 271; 493/459, 460, 461; 226/97, 39, 197, 195; 242/76

[56] References Cited

U.S. PATENT DOCUMENTS

| | | | |
|---|---|---|---|
| 2,658,432 | 11/1953 | Baumgartner | 162/271 |
| 2,893,053 | 7/1959 | Powell | 162/270 |
| 2,918,897 | 12/1959 | Zernov | 162/271 |
| 3,498,878 | 3/1970 | Obenshain | 162/271 |
| 3,567,093 | 3/1971 | Johnson | 226/97 |
| 4,182,472 | 1/1980 | Peekna | 226/97 |
| 4,360,356 | 11/1982 | Hall | 162/271 |

*Primary Examiner*—S. Leon Bashore
*Assistant Examiner*—K. M. Hastings
*Attorney, Agent, or Firm*—Hill, Van Santen, Steadman & Simpson

[57] ABSTRACT

An automatic decurling apparatus is provided for webs of paper material in which two small diameter decurling bars are adjusted into both sides of the web run between two closely spaced rollers around which the web passes in an S-wrap. The decurling bars can be independently adjusted into the web in varying degrees to compensate for predominant curl in one direction of the web. Additional decurling can be obtained by chilling the rollers, incorporating high-intensity dryers in the web path or by moisturizing one or both sides of the web prior to its passing the decurling bars.

12 Claims, 3 Drawing Figures

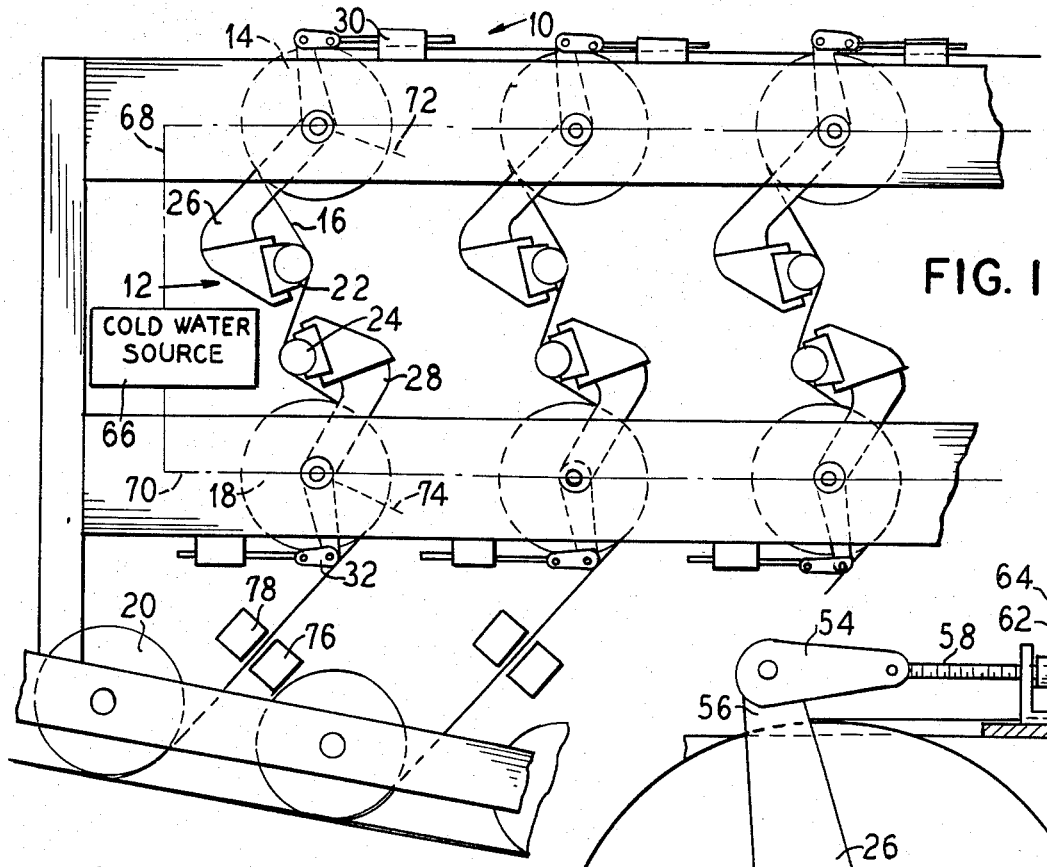
FIG. 1
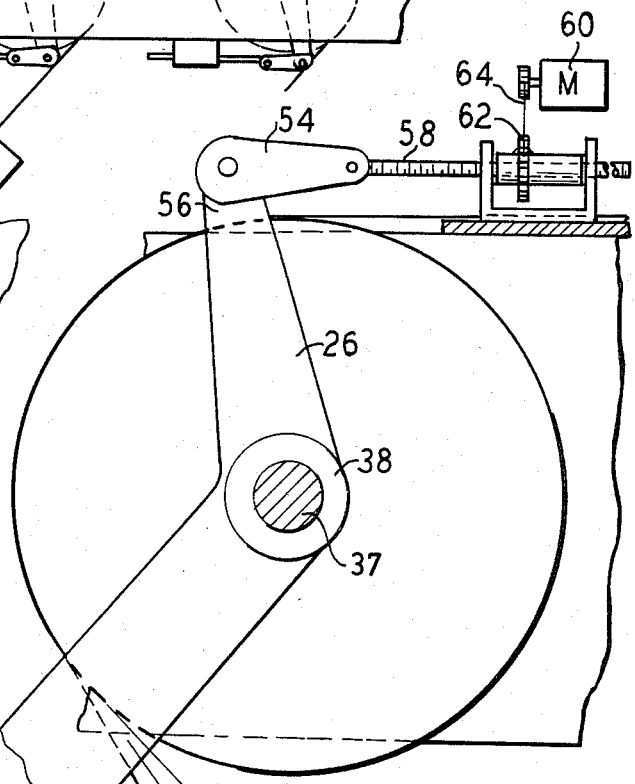
FIG. 2
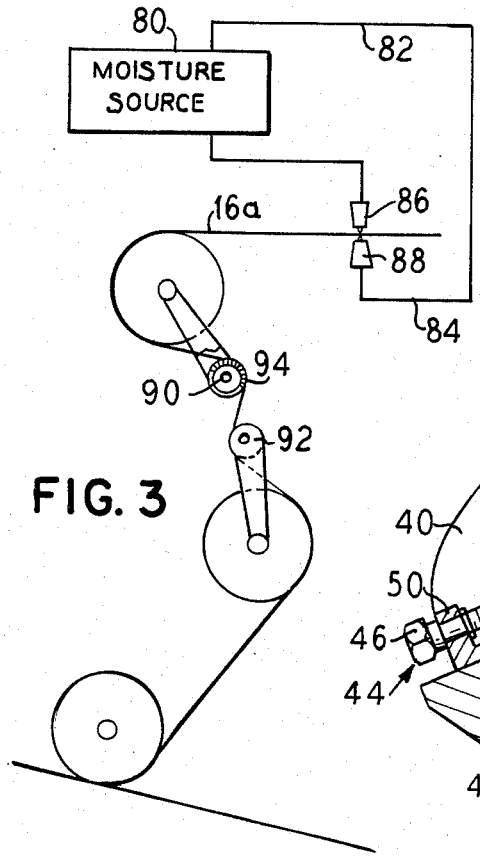
FIG. 3
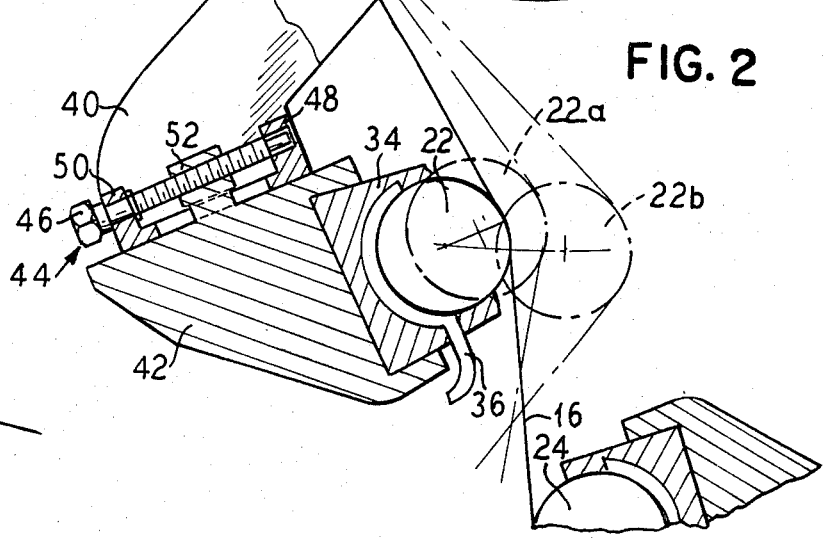

CURL NEUTRALIZER

BACKGROUND OF THE INVENTION

1. Field of the Invention

The present invention relates to decurling apparatus for paper web machinery and more particularly to double bar automatic decurling apparatus.

2. Description of the Prior Art

Paper coming from the paper machine in a roll can have various types or curl. This curl, through any subsequent machine which sheets paper, can cause jams or other disruptions.

Core curl is one of the most common types of curl. This occurs as the paper is loosing moisture within the roll and is wrapped around a small diameter core. The paper assumes the shape of the core and the layers of paper around the core. Consequently, the amount of in-the-machine direction curl would increase as the paper unwinds and gets closer to the core. This variable curl is very hard to anticipate and in the case of heavy weight paper, the diameter of the unwinding roll changes so fast that an operator is hard pressed to be able to adjust the decurler bar the correct amount and at the right time. Other types of curl, for example, cross-machine direction, cannot be easily adjusted for without creating other curl within the sheet.

Two types of decurlers are presently used in a sheeting operation, a sharp edged bar type and a roller bar type. The roller type is used where sliding abrasion cannot be tolerated. The sharp edge bar acts not unlike drawing a pice of paper across the edge of a table to produce curl. However, in the case of a sheeting operation, one is trying to overcome existing curl by attempting to curl the sheet in the oposite direction. Since the amount of curl varies as the roll unwinds, remote operator adjustments are necessary during the life of the roll which requires constant monitoring by the operator.

SUMMARY OF THE INVENTION

The present invention provides an apparatus which neutralizes the curl in the paper web by bending it first on one direction and then in an opposite direction. This is done on a continuous basis and requires no adjustment during the unwind operation.

The invention consists of two paper rolls spaced fairly close together. The web passes over one and under the other of the rolls in a standard S-wrap. Rotating around each roll is an air-bearing of sorts. The bars are adjusted into the web run, each to a different degree, so as to compensate for predominant curl in one direction. The air-bearing means is used to give full width support to a small diameter bar. This bar can then be used on all paper grades since it does not cause abrasion of the paper.

Tests show, by having a short draw between web carrying rolls, and by penetrating a small diameter bar into opposite sides of the web between the rolls, that the web will be flexed enough to neutralize any curl coming into the decurling device.

An alternative embodiment of the invention is to make the two rolls chill rolls, in order to add a certain amount of moisture to a particular side of the sheet, as a web usually curls toward the last side of the sheet to be dried. In a further embodiment of the invention, and to be used on difficult curl problems, is the addition of a high-intensity drier to both sides of the sheet. The dryer and the chill roll application can be done on one or both sides of the sheet, and these components would be used only on difficult curl applications. The addition of steam or water is another enhancement which would also moisten the sheet, plus minimize static as an additional feature.

BRIEF DESCRIPTION OF THE DRAWINGS

FIG. 1 is a side schematic view of an apparatus embodying the principles of the present invention including multiple decurlers.

FIG. 2 is an enlarged side view of one decurler bar and associated structure.

FIG. 3 is a schematic view of an alternative embodiment of the invention.

DESCRIPTION OF THE PREFERRED EMBODIMENTS

In FIG. 1, there is shown an automatic decurling apparatus 10 which is comprised of a plurality of decurling mechanisms 12. Each of the decurling mechanisms 12 is comprised of a first roll 14 over which passes a web 16 of paper material. A second roll 18 is positioned downstream of the first roll 14 and the web passes over the first roll and under the second roll 18 in a standard S-wrap arrangement. An optional third and further downstream roll 20 changes the direction of the web 16 and directs it toward the next stage in the paper making process.

Positioned between the two rolls 14 and 18 are two decurling bars or rods 22, 24, each of which are carried on an arm 26, 28 which is pivotally mounted at the axis of the top roll 14 or bottom roll 18 respectively. A distant end of the arms 26, 28 is connected to a mechanism 30, 32 which is adjustable to cause the arms 26 or 28 to pivot.

The decurling bars 22, 24 should have a relatively small diameter, 64 to 127 mm (0.25 to 0.5 inches), depending on the application. The combination of the short draw between the rolls 14, 18 and the small diameters of the bars 22, 24 provide the necessary bending and flexing of the paper web 16 to remove the curl in most applications. Additional means are described below for removing curl automatically in difficult curl applications.

One option of the decurling mechanism is shown in greater detail in FIG. 2 where it is seen that the decurling bar 22 is mounted in an air-bearing 34 which gives full width support to the decurling bar which has a small diameter. It also allows the decurling bar 22 to rotate in the bearing thereby preventing any undesirable abrasion between the decurling bar 22 and the web 16. A connecting conduit 36 supplies air to the air-bearing. Another option is to use a small diameter porous bar which provides for air flotation of the web instead of a rotating device. Such a device is shown in FIG. 3.

The arm 26 is pivotally mounted on a pivot pin 37 captured in a bearing 38, the decurling rod 22 being mounted on a first end 40 of the arm 26. One particular arrangement for mounting is shown in FIG. 2 in which the air-bearing 34 is held in a mounting block 42 which is connected to the first end 40 of the arm 26 by an adjustable mounting mounting arrangement 44. This adjustable arrangement can be in the nature of a captured screw 46 which is restrained at each end by a flange 48, 50 extending from the end 40 of the arm and passes at its midpoint through an extension 52 of the mounting block 42 which has a threaded passage 553 therethrough. As the screw is rotated, the mounting block will move laterally relative to the arm 26 thereby adjusting the lateral position of the decurling bar 22 as shown by the position in phantom at 22*a*. Alternatively, the mounting block 42 could be rigidly attached to the end 40 of the arm 26.

The arm adjusting mechanism 30 is comprised of a pivotally mounted link 54 which is pivotally attached at a first end 55 to a second end 56 of the arm 26. The link is pivotally connected at a second end to a threaded rod 58 which can either be manually rotatable or can be automatically rotated such as by a motor 60 driving a gear or captured nut 62 by known connecting drive means 64.

As the adjusting means is operated by rotating the captured nut 62, the threaded rod 58 moves back and forth relative to the nut 62 thereby causing the second end 56 of the arm 26 to move similarly and causing the first end 40 and thereby the decurling rod 22 to move oppositely. The decurling rod is shown rotated further into the web 16 in phantom in FIG. 2 at 22*b*. Thus, the decurling bar 2 can be adjusted into the web 16 to a greater or lesser degree as is required by the particular application. The same mechanism is used to rotate the arm 28 carrying the second decurling bar 24. In all respects, the two decurling bars and their mounting and adjusting mechanisms are identical.

In one embodiment of the invention, decurling of the paper web 16 can be enhanced, particularly if the web has a difficult curl problem, by making the top and bottom rollers 14 and 18 chill rolls as is shown in FIG. 1. In this embodiment, a source of cold water 66 is provided which is connected by appropriate conduits 68, 70 to the interior of the rolls 14, 18 respectively. Discharge conduits 72, 74 are also provided so that there is a continuous flow of cold water through the rolls 14, 18. By providing the chill rolls, a certain amount of moisture is added to a particular side of the web sheet as it passes the roll being chilled. This is beneficial in that a web usually curls toward the last side of the sheet to be dried.

Another embodiment of the invention which is also shown in FIG. 1 is to provide the addition of a high-intensity dryer 76, 78 on both sides of the web 16. As with the chill roll application, the dryers can be used on either or both sides of the sheet as desired and required, especially in difficult curl applications.

An additional embodiment of the invention is shown in FIG. 3 in which there is a source of moisture 80, being in the water or steam form, which is connected by appropriate conduits 82, 84 to nozzles 86, 88 positioned on opposite sides of the web 16*a*. Thus, as the web is fed into the decurling apparatus one or both sides of the sheet can be moistened as required. In addition to helping to decurl the sheets, the use of steam or water would minimize static.

Porous stationary bars 90, 92 are utilized in this embodiment rather than rotating bars. The bars 90, 92 are connected to a source of air under pressure (not shown). Air escapes through holes 94 in the bars and provides a cushion of air between the bars 90, 92 and the web 16*a*. Thus, the web 16*a* passes over the bars without abrasion.

A decurling apparatus constructed in accordance with the principles of the present invention could also combine chill rolls, high-intensity dryers and moisture spray nozzles so that any one or a combination of those mechanisms could be utilized depending on the characteristics of the particular paper web being fed through the mechanism.

It is seen, that the above disclosed and described invention automatically decurls a web of paper 16 passing through the apparatus by first bending the paper in one direction and thereafter bending the paper web in a second opposite direction around a pair of small diameter decurling bars. The double bending has been found to neutralize curl in webs on a continuous basis without requiring adjustment during the unwind operation. The decurling bars 22, 24 are to be adjusted into the web run, each to a different degree to compensate for predominant curl in one direction depending on the particular curl of the roll being neutralized. Once the initial placement of the decurling rolls, 22, 24 is established, no further adjustment is usually required during the run of that roll.

As is apparent from the foregoin specification, the invention is susceptible of being embodied with various altrations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. An automatic decurling apparatus for a web of paper material comprising:

a first roll mounted on an axle for carrying the web of paper, the web wrapping around said first roll with a first side engaging said roll, a second roll mounted on an axle downstream of said first roll for carrying the web of paper, the web wrapping around said second roll with a second side engaging said second roll, a first decurling bar carried in a mounting block, a first pivot arm carrying said mounting block at one end, said pivot arm being pivotally connected intermediate its ends to said first roll axle, a link member pivotally connected to an end of said pivot arm opposite the end carrying said mounting block, means for adjusting the position of said link member to effect pivotal movement of said first pivot arm permitting selective adjustment of said first decurling bar into one of said sides of the paper in a portion of the web between said two rolls, a second decurling bar carried in a mounting block, a second pivot arm carrying said mounting block at one end, said pivot arm being pivotally connected intermediate its ends to said second roll axle, a link member pivotally connected to end of said second pivot arm opposite the end carrying said mounting block, means for adjusting the position of said link member to effect pivotal movement of said second pivot arm permitting independent selective adjustment of said second decurling bar into a side of the web opposite the side engaged by the first decurling bar, whereby, said first and second decurling bars can be adjusted independently and simultaneously into opposite sides of the web between said two rolls.

2. The device of claim 1 wherein said decurling bars are rotationally mounted so as to roll with the paper web to reduce abrasive action between said bars and the web.

3. The device of claim 1 wherein said decurling bars comprise porous air bar supports that float the web over the bar.

4. The device of claim 2 wherein said decurling bars are supported throughout their length by air-bearings.

5. The device of claim 1 wherein a chilled liquid is selectively circulated through at least one of said rolls to add moisture to a particular selected side of the web.

6. The device of claim 1 wherein high-intensity dryers are arranged on either side of the web downstream of the second roll to remove moisture from a selected side of the web.

7. The device of claim 1 wherein moisture spraying nozzles are arranged on either side of the web upstream of said decurling bars to add moisture to a selected side of the web.

8. The device of claim 7 wherein said bars have diameters in the range of approximately 64 to 127 millimeters.

9. The method of removing curl from a web of paper comprising the steps:

mounting a first roller on an axle for carrying the web of paper, wrapping the web around said first roller with a first side engaging said roller, mounting a second roller on an axle downstream of said first roller for carrying the web of paper, wrapping the web around said second roller with a second side engaging said second roller, mounting a first decurling rod in a mounting block, attaching said mounting block at a first end of a pivot arm, pivotally connecting said pivot arm intermediate its ends to said first roller axle, pivotally connecting a link member to said pivot arm at an opposite the end carrying said mounting block, adjusting the position of said link member to effect pivotal movement of said first pivot arm to adjust said first decurling rod into one of said sides of the paper web in a portion of the web between two rollers, mounting a second decurling rod in a mounting block, attaching said mounting block at one end of a second pivot arm, pivotally connecting said second pivot arm intermediate its ends to aid second roll axle, pivotally connecting a link member to an end of said second pivot arm opposite the end carrying said mounting block, adjusting the position of said link member to effect pivotal movement of said second pivot arm, independently adjusting said second decurling rod into a side of the web opposite the side engaged by the first decurling rod.

10. The method of claim 9 including the step of chilling at least one of the rollers.

11. The method of claim 9 including the step of drying at least one side of the web with a high-intensity dryer after bending around the rods.

12. The method of claim 9 including moisturizing at least one side of the web with a moisture spray prior to bending around the rods.

* * * * *